US009281573B2

(12) United States Patent
Beck et al.

(10) Patent No.: US 9,281,573 B2
(45) Date of Patent: Mar. 8, 2016

(54) ELECTRICAL PLUG CONNECTOR FOR ELECTRICAL CONNECTION BY MEANS OF ULTRASONIC WELDING

(71) Applicant: Amphenol Tuchel Electronics GmbH, Heilbronn (DE)

(72) Inventors: Till Beck, Heilbronn (DE); Peter Bednarczyk, Heilbronn (DE); Stefan Schulz, Neckarsulm (DE); Wolfgang Langhoff, Leonberg (DE); Danica Holley, Neuenstadt (DE)

(73) Assignee: Amphenol Tuchel Electronics GmbH (DE)

( * ) Notice: Subject to any disclaimer, the term of this patent is extended or adjusted under 35 U.S.C. 154(b) by 0 days.

(21) Appl. No.: 14/370,555

(22) PCT Filed: Feb. 8, 2013

(86) PCT No.: PCT/EP2013/000374

§ 371 (c)(1),
(2) Date: Jul. 3, 2014

(87) PCT Pub. No.: WO2013/117339

PCT Pub. Date: Aug. 15, 2013

(65) Prior Publication Data

US 2014/0378010 A1 Dec. 25, 2014

(30) Foreign Application Priority Data

Feb. 11, 2012 (DE) ..... 10 2012 002 910
Feb. 11, 2012 (DE) ..... 20 2012 001 446 U

(51) Int. Cl.

| | |
|---|---|
| ***H01R 4/02*** | (2006.01) |
| ***H01R 43/02*** | (2006.01) |
| *H01R 13/04* | (2006.01) |

(52) U.S. Cl.
CPC ..... *H01R 4/023* (2013.01); *H01R 4/029* (2013.01); *H01R 43/0207* (2013.01); *H01R 13/04* (2013.01)

(58) Field of Classification Search
CPC .... H01R 4/023; H01R 43/0207; H01R 4/029; H01R 13/04; H01R 4/02; H01R 43/02
USPC ..... 439/874; 29/860
See application file for complete search history.

(56) References Cited

U.S. PATENT DOCUMENTS

| | | | | |
|---|---|---|---|---|
| 5,263,880 | A | 11/1993 | Schwarz et al. | |
| 6,142,838 | A | 11/2000 | Shinchi | |
| 7,008,273 | B2 * | 3/2006 | Zhou | 439/874 |
| 7,364,478 | B2 * | 4/2008 | Xu | 439/874 |
| 7,828,610 | B2 * | 11/2010 | Lehmann et al. | 439/874 |
| 2003/0143875 | A1 | 7/2003 | Kamiya | |

FOREIGN PATENT DOCUMENTS

| | | |
|---|---|---|
| DE | 19800451 | 7/1998 |
| DE | 102010027033 | 1/2012 |
| EP | 2416457 | 2/2012 |

* cited by examiner

*Primary Examiner* — Javaid Nasri
(74) *Attorney, Agent, or Firm* — Blank Rome LLP

(57) ABSTRACT

An electrical plug connector in the form of a solid contact pin that has a contact portion, a transition portion adjoining the contact portion, and a connection portion adjoining the transition portion for electrical connection to an electrical line by ultrasonic welding. The connection portion is formed from a first leg and a second leg and has at least one geometric wave refraction element for refracting waves during ultrasonic welding.

16 Claims, 2 Drawing Sheets

ELECTRICAL PLUG CONNECTOR FOR ELECTRICAL CONNECTION BY MEANS OF ULTRASONIC WELDING

RELATED APPLICATION

This application is a National Phase of PCT/EP2013/000374, filed on Feb. 8, 2013, which claims priority to German Patent Application No. 10 2012 002 910.1 and German Patent Application No. 20 2012 001 446.3, filed Feb. 11, 2012, all of the disclosures of which are hereby incorporated by reference herein.

FIELD OF THE INVENTION

The invention relates to an electrical plug connector

The invention in particular relates to an electrical plug connector formed as a contact pin for electrical connection to a cable by means of an ultrasonic welding process.

PRIOR ART

BACKGROUND OF THE INVENTION

Electrical plug connectors are intended to produce a releasable electrical connection via their plug connector pairs, therefore via their socket parts and plug parts, for example between an electrical line and a further electrical line or an electrical apparatus.

Here, different connection methods are known in the prior art for connecting a cable or an electrical line to the plug connector.

Besides screw connections, crimp connections, soldered connections, press-in or piercing connections and other connection techniques are known, such as form-fit connections, in particular welded connections.

In most applications it is usually desirable to produce a particularly durable connection between the contact of an electrical plug connector and the cable to be connected.

In particular in the automotive industry, high demands are placed on the durability and reliability of an electrical connection.

In particular it is a requirement that, in a reliable and lasting manner, the line to be connected to the contact does not lead to a detachment of the connection, even when exposed to temperature fluctuations and mechanical vibrations and interferences during use of the vehicle.

The current and future developments of electric motors and hybrid technology in the automotive sector also require contact arrangements with high current-carrying capability that produce a reliable connection even at increased temperatures, in particular as a result of inherent heating.

With temperature-change operation, such contact materials in particular are not suitable, since they fail over time as a result of relaxation processes with the alternating temperature rise and cooling and may detach from the cable.

The ultrasonic welding process has proven to be a particularly suitable welding process for producing high-strength connections of certain materials, but again encounters significant problems with the connection of certain contact materials.

There are thus various tests for ascertaining which material damage occurs when sufficient welding energy is applied by ultrasonic welding.

In material tests it has been found that the connection portions of contact pins suffer considerable damage in part and have a tendency to crack formation when a copper cable is connected to a copper contact by means of ultrasonic welding.

In addition, there are fundamental questions concerning the correct design of contact geometries for the reliable design of an ultrasonic weld to a cable.

SUMMARY OF THE INVENTION

An object of the present invention is to provide an electrical plug connector or a contact pin for electrical connection by means of an ultrasonic welding process, which overcomes the aforementioned problems and has an optimized geometry in particular with respect to the installation space.

In addition, a further object is to provide such a contact pin that can be used universally and cost-effectively and in many applications.

The underlying concept of the invention is that a plug connector, in particular in the form of a solid contact pin, has the following: a contact portion, which is preferably connected to a connection portion via a transition portion, wherein the connection portion is designed for electrical connection to an electrical line by means of ultrasonic welding and therefore a wave refraction unit or a geometric wave refraction element for refracting the ultrasonic waves is arranged in this region, preferably in the transition region between the connection portion and the adjoining transition or contact portion.

The technical effect of the wave refraction element can be considered the fact that, when energy is applied by means of ultrasonic welding, cracks and damage may occur in the region of the connection portion, in particular at the transition region thereof to the contact portion or the transition portion therebetween, in particular as a result of the waves occurring. Such transition portions are zones that are particularly loaded during ultrasonic welding.

To prevent damage, it is therefore necessary to provide a suitably formed wave refraction element, preferably an appropriately formed bead, on the connection portion.

In accordance with the invention, an electrical plug connector is therefore proposed which comprises a contact portion, a transition portion adjoining the contact portion, and a connection portion adjoining the transition portion, wherein the connection portion is designed for electrical connection to an electrical line by means of ultrasonic welding, and wherein the connection portion is formed via at least one geometric wave refraction element, preferably a protruding bead for refracting waves during ultrasonic welding.

The connection portion has a support surface, preferably a flat support surface, for a line to be connected or the contact end of a line to be connected.

In a particularly advantageous manner, the connection portion is formed as an L-shaped connection portion, more specifically from a first leg and a second leg oriented substantially orthogonally thereto, wherein each leg is part of the connection portion. The two legs are consequently connected in a manner oriented substantially perpendicularly to one another and form the L-shaped connection portion form.

It is thus ensured that an ideal installation space is available for the electrical plug connector, since, with a sufficiently thin design of the second leg, which advantageously also forms the support surface for the line, since it is only selected to be so thick that the total thickness of the line and of the leg is approximately equal to or insignificantly greater than the thickness of the overall contact.

Such a geometry is therefore optimized in terms of installation space and at the same time provides a stop for the cable provided by the first leg and a stop surface for the cable provided by the second leg.

In an advantageous embodiment the first leg is arranged on the transition portion.

Further, the second leg is advantageously connected to the first leg in an orientation substantially orthogonal to said leg, such that an L-shaped connection portion is formed, which is either formed integrally with the transition portion with its overall orientation in the plug-in direction or is formed integrally on the transition portion perpendicularly to the plug-in direction.

In order to substantially eliminate the damage caused by the longitudinal waves during ultrasonic welding, a preferred design according to the invention in the form of an elongate plug connector is provided, in which the first leg is arranged on the transition portion in the plug-in direction such that the second leg is arranged substantially in the direction of extension and therefore in the plug-in direction of the contact pin.

The support surface of the second leg advantageously has a transition surface, which is connected to the leg inner surface formed by the first leg or extends directly thereinto.

Figuratively speaking, the shape of a half "half-pipe" is approximately formed, in which the support surface of the second leg forms the base and the curved transition surface with the leg inner surface laterally constitutes the rounding of the "half-pipe".

In other words, the inner surfaces, that is to say the surfaces facing the other leg in each case, are interconnected via a curved transition surface. The curved transition surface corresponds substantially approximately to a segment of the inner periphery of a hollow cylinder from approximately 70° to 90° radian.

The radius of curvature of the curved transition surface is advantageously constant over the entire transition surface, wherein the geometric wave refraction element protrudes from the transition surface.

In a preferred embodiment the geometric element is formed as a bead, which is likewise curved, protruding outwardly from the transition surface along the curvature.

In a particularly preferred embodiment the bead extends in its progression over the entire curved surface, more specifically over the entire height of the first leg and runs via its other end into the flanks or into the surface of the second leg.

The bead is advantageously located approximately in the middle of the transition surface with respect to the side edges of the connection portion formed by the L.

In other words, in one view the projection of the bead is oriented parallel to the plug-in direction of the contact pin.

The longitudinal ultrasonic waves forming in the contact pin are consequently interrupted by the wave refraction element formed in longitudinal orientation and are inhibited in terms of their effect, such that the contact pin can be connected to a line in a damage-free manner by means of ultrasonic welding.

Comparative tests between contact elements that have merely been connected at a connection tongue to a line by means of ultrasonic welding and those that were formed by means of a corresponding wave refraction contour have shown that, in the first group of contact elements, damage and/or cracks could be detected at the transition region in practically all cases, whereas this was not the case with the contact elements according to the invention.

In a particularly preferred embodiment the connection portion and the geometric wave refraction element, that is to say preferably the bead, are formed in a materially bonded manner from one material, more specifically preferably from pure copper or a copper alloy.

The use of copper or a copper alloy with high copper content is preferable due to the particularly good electrical conductivity.

In any case, the suitable design of a wave refraction element between or at the connection portion to the transition of the transition or contact portion is decisive for the technical effect of the contact according to the invention.

A further preferred embodiment is an electrical plug connector according to one or more of the preceding features, wherein the contact pin consists of a metal material, and wherein the contact pin has a galvanic surface coating and the transition portion has a support surface, which has no surface coating and no coating applied otherwise.

A further preferred embodiment is an electrical plug connector according to one or more of the previous features, wherein the connection portion has a preferably planar support surface for an electrical line to be connected.

A further preferred embodiment is an electrical plug connector according to one or more of the previous features, wherein the metal material of the contact pin consists of copper or a copper alloy with high copper content and/or the galvanic coating of the contact pin consists of silver or gold or tin.

Combinations of two or more features are deemed to be disclosed in accordance with the invention.

BRIEF DESCRIPTION OF THE DRAWINGS

Further advantages and expedient embodiments can be inferred from the further claims, the description of the figures, and the drawings, in which:

DETAILED DESCRIPTION OF THE PREFERRED EMBODIMENT

Figure 1:
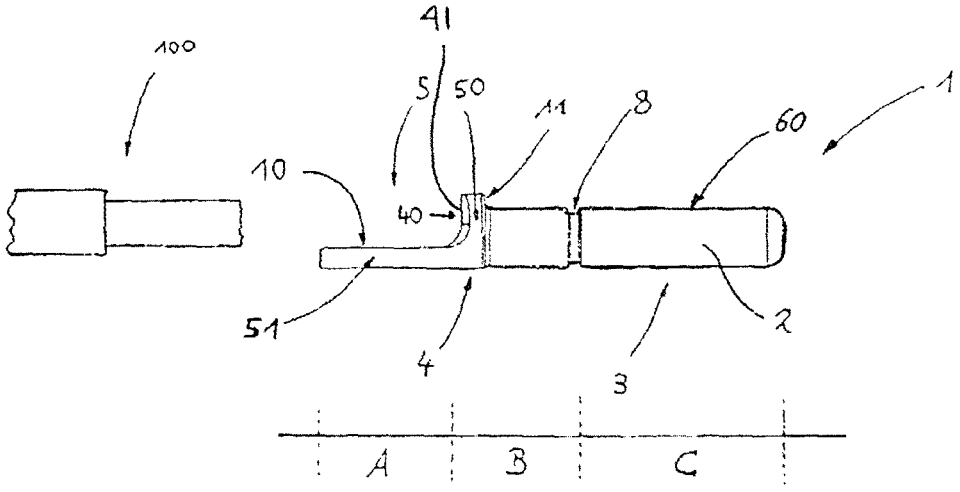
FIG. 1 shows an electrical plug connector for electrical connection by means of ultrasonic welding.

In accordance with FIG. 1, the electrical plug connector 1 is provided in the form of a contact pin 2. The contact pin 2 is divided into the portions A, B and C. The portion C constitutes the contact portion 3 of the contact pin 2. The contact portion 3 serves to contact a corresponding mating plug. Immediately adjacently thereto, the contact pin divides into a transition portion 4 in portion B. A detent contour 8 for latching with a detent element on the mating plug is arranged between the transition portion 4 and the contact portion 3. The transition portion 4 is adjoined in part A of the contact pin 2 by the connection portion 5.

The connection portion 5 of the contact pin 2 serves for the electrical and mechanical connection to a cable to be connected or a line 100 to be connected. The connection portion 5 is formed as an L-shaped connection portion, wherein part of the L-shape is part of the transition portion. The L-shape of the connection portion 5 is produced by a first leg 50 and a second leg 51 arranged orthogonally thereto. The leg is connected to the transition portion 4 directly thereon. On the side opposite the connection, the leg has a leg surface 40, which is substantially horizontal and then curves, as it progresses further, with a radius of curvature R and leads or transitions into a support surface 10 of the second leg 51. The second leg 51 is formed as a substantially flat leg, which is arranged in the axial direction of the contact pin 2, more specifically at the end thereof. The underside and therefore the side of the second leg 51 opposite the support surface 10 is advantageously likewise flat so as to achieve a minimal installation space.

The contact portion 3 and the transition portion 4 are formed with a first diameter D1, substantially as cylindrical portions. The connection portion 5 protrudes via a projection 11 beyond the outer contour and therefore beyond the sleeve shape of the cylindrical outer sleeve of the contact pin 2 formed by the contact portion 3 and the transition portion 4.

As a result of the projection 11, the plug connector provides a mechanical rest against a housing for example, so as to ensure that the contact pin 2 can be brought with its contact portion 3 into the correct plug-in position.

Figure 2:
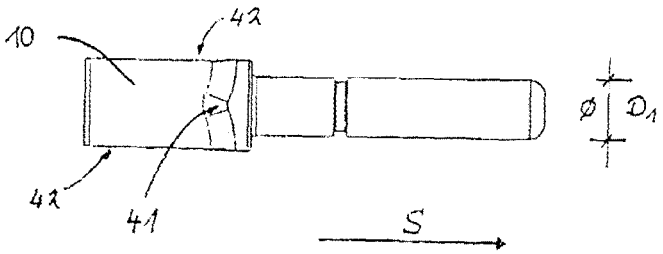
FIG. 2 shows a perspective view of the contact.

As can be seen in FIG. 1 and FIG. 2, the progression of the support surface 10 from the second leg 51 to the leg surface 40 of the first leg 50 is formed as a curved surface. The curvature substantially follows approximately the shape of one half of a "half-pipe". In other words, the base surface is formed by the support surface 10, whereas the half-pipe side surfaces are formed by the curved leg surface 40.

As can be seen in FIG. 2, the wave refractor 41 protrudes from the leg surface 40. The wave refractor 41 is formed in the present exemplary embodiment as a bead or hump and more specifically forms a curved bead, of which the projection extends in the axial direction S or plug-in direction S of the contact pin 2, as can be seen in FIG. 2.

In other words, the bead 41 runs from the support surface 10 along the axial direction upwardly over the curvature of the curved leg surface 40 as far as the end 53 thereof and more specifically approximately as far as the upper end of the projection 11.

The hump thus formed serves as a wave refractor 41 in the connection portion 5, in particular so as to refract longitudinal waves.

As indicated in FIG. 1, a stripped end of a cable 100 is to be applied to the support surface 10 and an ultrasonic welded connection is to be formed between the cable 100 and the contact pin 2 or connection portion 5 thereof by means of ultrasonic waves, that is to say by means of ultrasonic welding.

The longitudinal waves and ultrasonic waves occurring during this process are interrupted by the wave refractor 41 at the "critical" transition to the transition portion 5, such that the energy of the ultrasonic waves, in particular in the region of the transition from the connection portion 5 to the transition portion 4, does not lead to any function-impairing interferences or material damage.

It can be seen in FIG. 2 that the hump or the bead 41 is arranged substantially in the middle between the side edges 42 of the legs 50, 51.

Alternatively, two parallel wave refractors 41, that is to say two humps or two beads 41, could also be arranged side by side in the transition region, the geometric design of said humps or beads causing the refraction of ultrasonic waves.

The formation of a single central and curved bead 41 has proven to be particularly efficient. This is because an optimal wave refraction of ultrasonic waves occurs in this way.

The connection portion 5 illustrated in FIG. 1 and FIG. 2 does not have a surface coating on its support surface 10, such that contact occurs directly with the material of the contact pin 2.

The material of the contact pin 2 is advantageously formed as a copper material or a copper alloy with high copper content.

The contact portion 3 can be provided advantageously with a surface coating, such that the electrical plug connector according to the invention can be provided cost-effectively via partial coatings and is suitable in a favorable manner for ultrasonic welding.

In view of the application of heat, it has proven to be advantageous if the length of the second leg 51 is provided at a length from approximately 25% to 40% of the total length of the contact pin 2.

Consequently, the first leg 50 is distanced from the end of the connection portion 5 by a distance equal to approximately one third of the total length of the contact pin 2. Two thirds of the length of the contact pin 2 are formed by the transition portion 4 and the contact portion 3.

As can be seen in FIG. 2, the support surface 10 is advantageously greater in terms of its width than the diameter D1 of the contact portion 3 and transition portion 4. This improves the wave refraction effect of the wave refractor 41 in the region of the first leg 50.

Figure 3:
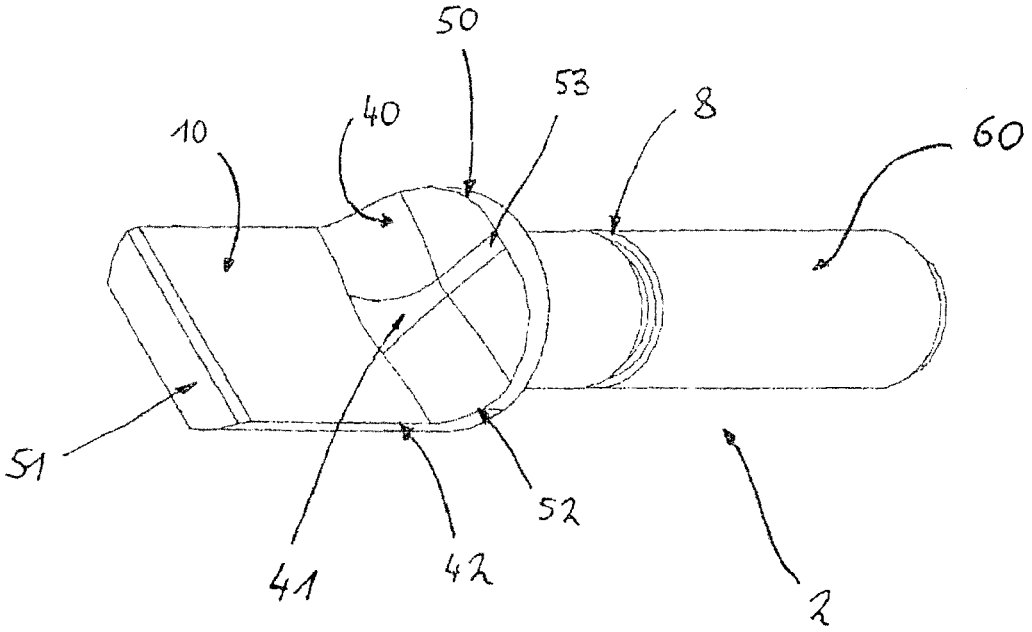
FIG. 3 shows a perspective view of the contact pin similarly to the embodiment from FIG. 1 and FIG. 2.

A perspective view of the contact pin 2 similarly to the embodiment from FIG. 1 and FIG. 2 is illustrated in FIG. 3.

It can be clearly seen in the perspective view how the mechanical wave refraction element or the wave refractor 41 is formed in the present exemplary embodiment.

LIST OF REFERENCE SIGNS

Electrical Plug Connector for Electrical Connection by Means of Ultrasonic Welding

1 electrical plug connector
2 contact pin
3 contact portion
4 transition portion
5 connection portion
8 detent contour
10 support surface
11 projection
40 leg surface
41 wave refractor
42 side edges of the legs 50, 51
50 first leg
51 second leg
52 curved transition portion
53 end of the bead
60 galvanic surface coating
100 cable/line
S axial direction/plug-in direction

The invention claimed is:

1. An electrical plug connector in the form of a solid contact pin that comprises the following:

A) a contact portion,

B) a transition portion adjoining the contact portion, and

C) a connection portion adjoining the transition portion for electrical connection to an electrical line by means of ultrasonic welding, wherein the connection portion is formed from a first leg and a second leg and has at least one geometric wave refraction element for refracting waves during ultrasonic welding.

2. The electrical plug connector as claimed in claim 1, wherein the connection portion has a preferably planar support surface for an electrical line to be connected.

3. The electrical plug connector as claimed in claim 1, wherein the connection portion is formed as an L-shaped connection portion, more specifically by the first leg and the second leg oriented substantially orthogonally thereto.

4. The electrical plug connector as claimed in claim 1, wherein the first leg is arranged on the transition portion.

5. The electrical plug connector as claimed in claim 1, wherein the connection portion is formed as an L-shaped connection portion, more specifically by the first leg and the second leg oriented substantially orthogonally thereto.

6. The electrical plug connector as claimed claim 1, wherein the support surface of the second leg is connected via a curved transition surface to a leg inner surface formed by the first leg and/or forms a common surface therewith.

7. The electrical plug connector as claimed claim 6, wherein the geometric wave refraction element is arranged in the region of the curved transition surface and protrudes out therefrom.

8. The electrical plug connector as claimed in claim 7, wherein the geometric wave refraction element is formed as a curved bead protruding outwardly from the transition surface.

9. The electrical plug connector as claimed in claim 1, wherein a bead extends in its position and therefore in its progression over the entire height of the first leg and reaches via one of its ends as far as the second leg.

10. The electrical plug connector as claimed in claim 1, wherein the connection portion and the geometric wave refraction element are formed in a materially bonded manner from a pure copper material.

11. The electrical plug connector as claimed in claim 1, wherein the contact pin has a partial surface coating.

12. The electrical plug connector as claimed in claim 11, wherein the connection portion has no surface coating in the region of the support surface, and a contact material for the ultrasonic welding consists in this region of the material of the contact pin.

13. The electrical plug connector as claimed in claim 1, wherein the contact pin consists of a metal material, and wherein the contact pin has a galvanic surface coating and the transition portion has a support surface, which has no surface coating and no coating applied otherwise.

14. The electrical plug connector as claimed in claim 13, wherein the galvanic coating of the contact pin consists of silver or gold or tin.

15. The electrical plug connector as claimed in claim 1, wherein the connection portion has a preferably planar support surface for an electrical line to be connected.

16. The electrical plug connector as claimed in claim 1, wherein a metal material of the contact pin consists of copper or a copper alloy with high copper content.

* * * * *